US011414284B2

(12) United States Patent
Maeda et al.

(10) Patent No.: US 11,414,284 B2
(45) Date of Patent: Aug. 16, 2022

(54) ACCOMMODATING DEVICE AND IMAGE FORMING APPARATUS

(71) Applicant: FUJIFILM BUSINESS INNOVATION CORP., Tokyo (JP)

(72) Inventors: Shoichi Maeda, Kanagawa (JP); Teruki Naganuma, Kanagawa (JP); Yohei Onoue, Kanagawa (JP); Yoshiki Kimura, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/155,407

(22) Filed: Jan. 22, 2021

(65) Prior Publication Data

US 2022/0081242 A1 Mar. 17, 2022

(30) Foreign Application Priority Data

Sep. 11, 2020 (JP) ..... JP2020-153094

(51) Int. Cl.
*B65H 1/04* (2006.01)

(52) U.S. Cl.
CPC ..... *B65H 1/04* (2013.01); *B65H 2402/443* (2013.01); *B65H 2405/11161* (2013.01); *B65H 2405/121* (2013.01); *B65H 2511/11* (2013.01); *B65H 2701/11312* (2013.01); *B65H 2801/06* (2013.01)

(58) Field of Classification Search
CPC ..... B65H 2405/121; B65H 2405/10; B65H 2405/11; B65H 2405/11161; B65H 1/04; B65H 2701/11312
See application file for complete search history.

(56) References Cited

U.S. PATENT DOCUMENTS 8,532,557 B2 * 9/2013 Kusumi ..... B65H 3/0669 399/367
9,359,157 B2 * 6/2016 Niikura ..... B65H 3/48
2016/0016740 A1 1/2016 Niikura et al.

FOREIGN PATENT DOCUMENTS

JP 2016-000653 A 1/2016

* cited by examiner

*Primary Examiner* — Jeremy R Severson
(74) *Attorney, Agent, or Firm* — Oliff PLC

(57) ABSTRACT

An accommodating device includes: a main body portion; a pulling-out portion on which recording media are loaded, the pulling-out portion being capable of being pulled out from the main body portion; a prevention portion configured to prevent the pulling-out portion from being pulled out by being locked to the main body portion in a state where the pulling-out portion is housed in the main body portion; and a fixing portion configured to fix the pulling-out portion to the main body portion in the state where the pulling-out portion is housed in the main body portion.

20 Claims, 10 Drawing Sheets

ACCOMMODATING DEVICE AND IMAGE FORMING APPARATUS

CROSS-REFERENCE TO RELATED APPLICATIONS

This application is based on and claims priority under 35 USC 119 from Japanese Patent Application No. 2020-153094 filed Sep. 11, 2020.

BACKGROUND

(i) Technical Field

The present disclosure relates to an accommodating device and an image forming apparatus.

(ii) Related Art

JP-A-2016-000653 discloses a sheet feeding device including: a housing; a sheet feeding tray that includes a loading plate on which sheets are loaded and is slidably attached to inside and outside of the housing; a transport unit that transports the sheets loaded on the loading plate in a direction orthogonal to both a sliding direction of the sheet feeding tray and a loading direction of the sheets; a long sheet option that is detachably attached to an upstream portion in a transport direction of the loading plate and includes an extension plate that extends the loading plate such that long sheets can be mounted; and a first locking unit that can hold the sheet feeding tray at a first locking position where the sheet feeding tray cannot slide when the long sheet option is attached and can hold the sheet feeding tray at a first unlocking position where the sheet feeding tray can slide when the long sheet option is removed.

SUMMARY

For example, when transporting a long sheet, it is difficult to correct oblique feed and lateral displacement of the sheet. For this reason, in a configuration including a pulling-out portion that can be pulled out from a main body portion, when a sheet placed in the pulling-out portion is placed obliquely, or when the pulling-out portion is placed obliquely with respect to a transport direction, the sheet at the time of feeding may be obliquely or laterally displaced.

Aspects of non-limiting embodiments of the present disclosure relate to an accommodating device and an image forming apparatus that, when a mounting member is mounted, prevents recording media loaded on the mounting member from being obliquely or laterally displaced with respect to a main body portion, as compared with a case where a pulling-out portion is restrained to the main body portion simply by a prevention portion.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an accommodating device including: a main body portion; a pulling-out portion on which recording media are loaded, the pulling-out portion being capable of being pulled out from the main body portion; a prevention portion configured to prevent the pulling-out portion from being pulled out by being locked to the main body portion in a state where the pulling-out portion is housed in the main body portion; and a fixing portion configured to fix the pulling-out portion to the main body portion in the state where the pulling-out portion is housed in the main body portion.

BRIEF DESCRIPTION OF THE DRAWINGS

Exemplary embodiment(s) of the present disclosure will be described in detail based on the following figures, wherein.

DETAILED DESCRIPTION

Figure 1:
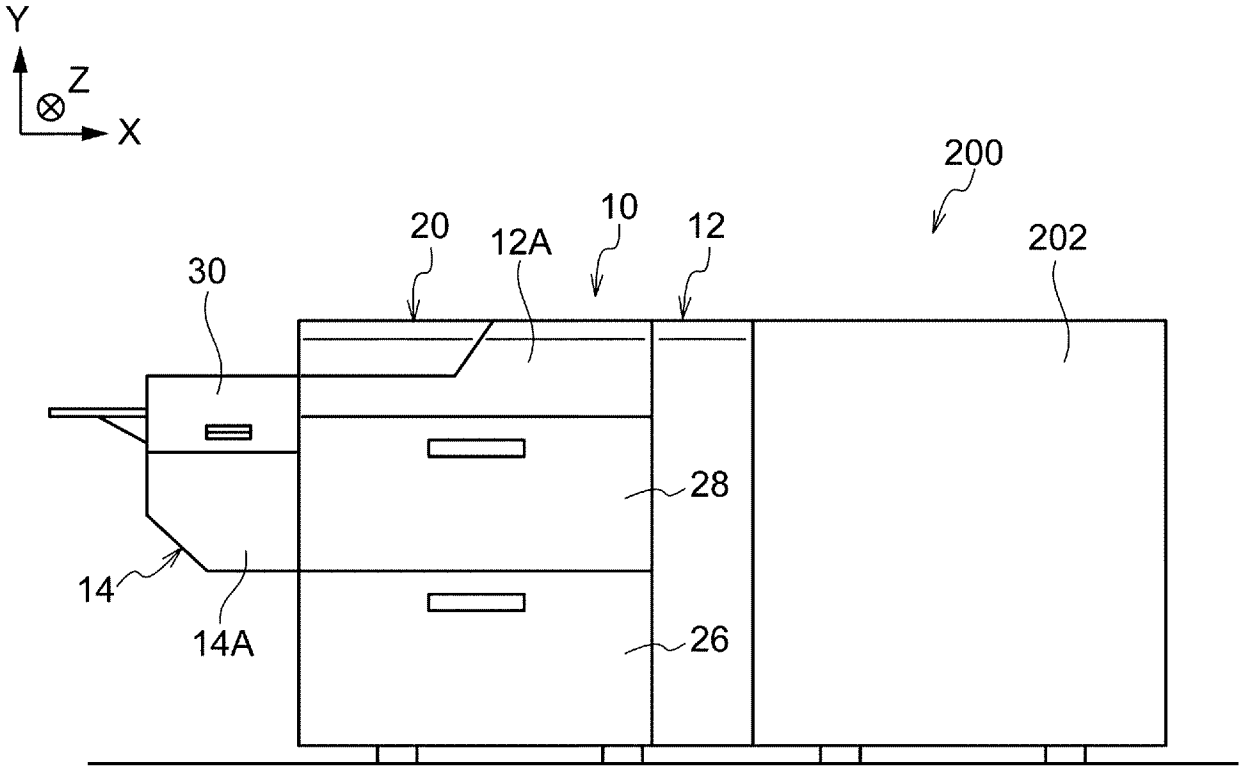
FIG. 1 is a front view showing an image forming apparatus including a sheet feeding device according to a first exemplary embodiment.

Exemplary embodiments of the present disclosure will be described below. In the following description, a direction indicated by an arrow X appropriately shown in the drawings is referred to as an "apparatus width direction", and a direction indicated by an arrow Y is referred to as an "apparatus height direction". A direction (the arrow Z direction) orthogonal to the apparatus width direction and the apparatus height direction is referred to as an "apparatus depth direction".

First Exemplary Embodiment

Configuration of Image Forming Apparatus

FIG. 1 is a front view of an example of an image forming apparatus 200 including a sheet feeding device 10 according to a first exemplary embodiment.

As shown in FIG. 1, the image forming apparatus 200 includes an image forming apparatus main body 202 (an example of an image forming unit) that forms an image on a recording medium, and the sheet feeding device 10 that feeds the recording medium to the image forming apparatus main body 202. The sheet feeding device 10 is an example of an accommodating device. The sheet feeding device 10 is disposed adjacent to a side portion of the image forming apparatus main body 202. Although not shown, the image forming apparatus main body 202 includes an image forming unit that forms the image on the recording medium, and a transport unit that transports the recording medium to the image forming unit. Configurations and arrangements of the image forming unit and the transport unit are not particularly limited. The sheet feeding device 10 is optionally attached to the image forming apparatus main body 202, and can be independently traded in the market.

Configuration of Sheet Feeding Device

Overall Configuration

Figure 2:
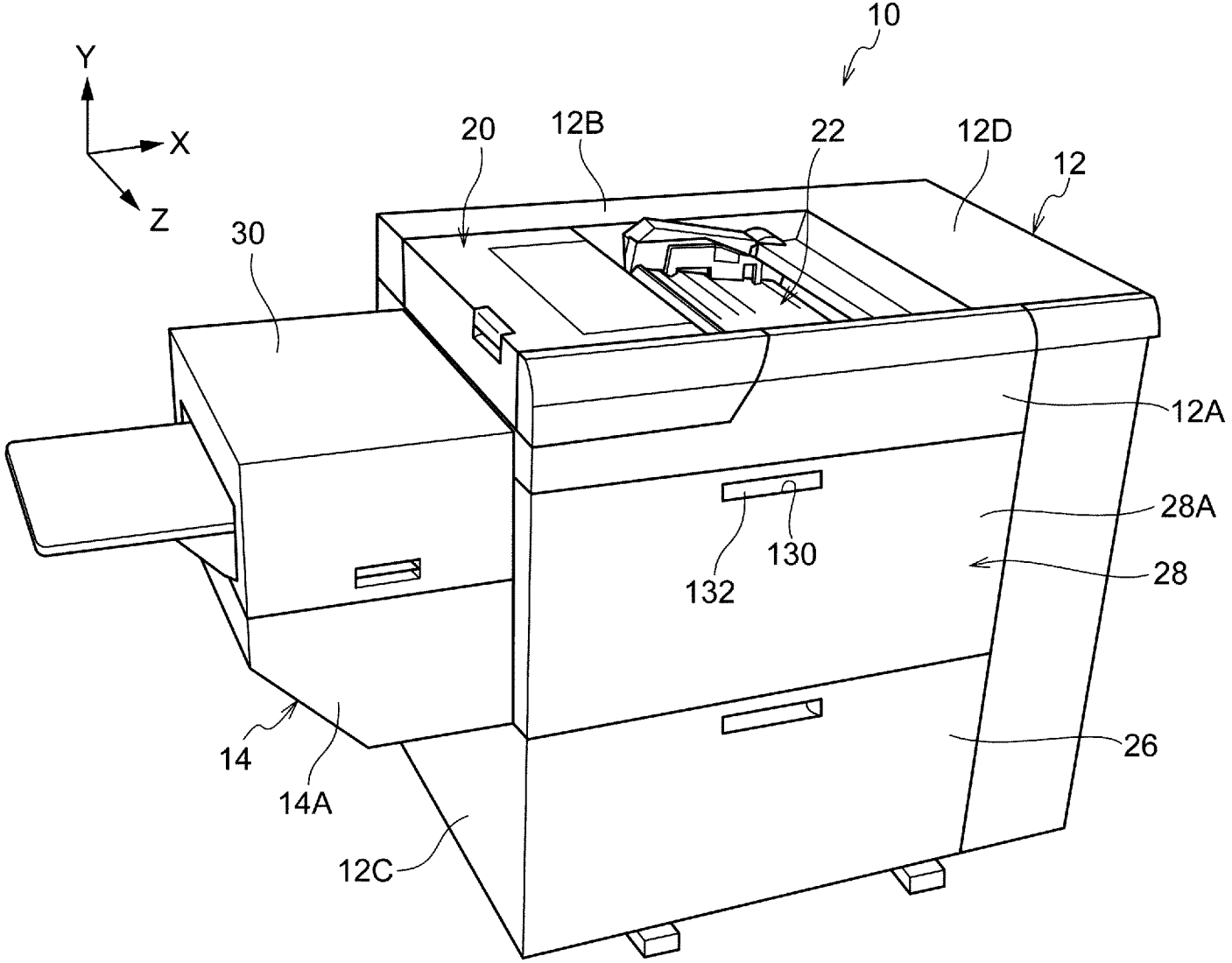
FIG. 2 is a perspective view showing the sheet feeding device according to the first exemplary embodiment.
Figure 3:
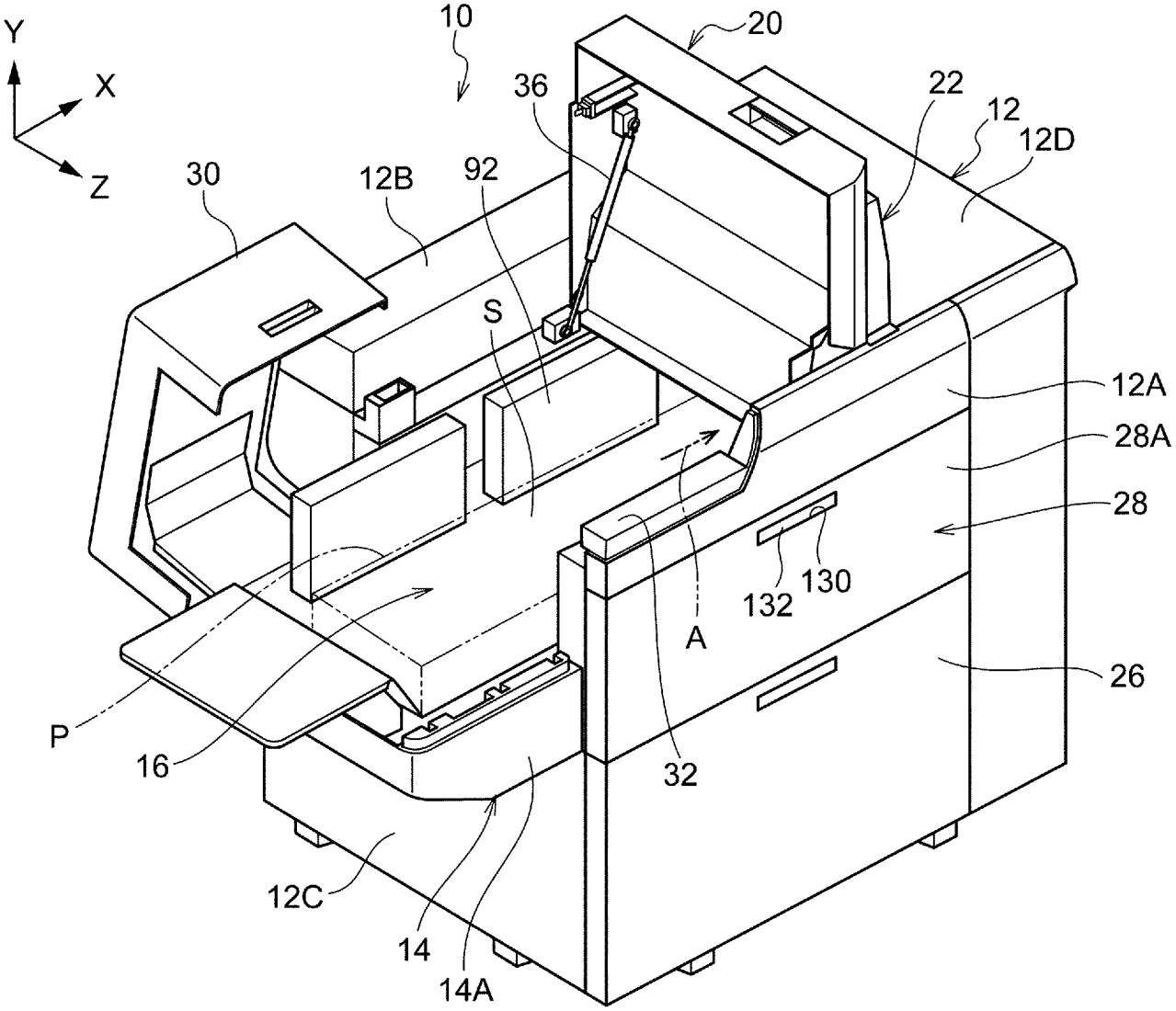
FIG. 3 is a perspective view showing a state where an opening-closing member and a rotating member which are used in the sheet feeding device according to the first exemplary embodiment are rotated to open a loading space on a loading portion.

FIG. 2 is a perspective view of the sheet feeding device 10 according to the first exemplary embodiment. As shown in FIG. 2, the sheet feeding device 10 includes a main body portion 12 as an device main body, and a mounting device 14 attached so as to protrude from a side portion of the main body portion 12 toward an outside of the main body portion 12. As shown in FIG. 3, a loading portion 16 on which plural recording media P are loaded is provided inside the sheet feeding device 10, and a loading space S is formed in an upper portion of the loading portion 16 (see FIG. 3). The mounting device 14 is an example of a mounting member detachably attached to the main body portion 12. The mounting device 14 is retrofittable to the sheet feeding device 10 optionally.

As shown in FIGS. 2 and 3, the sheet feeding device 10 includes an opening-closing member 20 disposed on an upper surface of the main body portion 12 and provided at a position so as to cover an upper side of the loading portion 16. The opening-closing member 20 opens and closes a loading space S on the loading portion 16 in the main body portion 12. The sheet feeding device 10 includes a damper 36 that assists an opening operation of the loading space S by the opening-closing member 20 (see FIG. 3). Further, the sheet feeding device 10 includes a rotating member 22 that is disposed so as to at least partially overlap with the opening-closing member 20 and is rotatable. A recording medium for manual feeding may be placed in a state where the rotating member 22 is disposed so as to overlap with the opening-closing member 20. An opening-closing cover 30 that opens and closes the loading space S on the loading portion 16 is provided at a portion of the mounting device 14 protruding from the side portion of the main body portion 12.

The sheet feeding device 10 includes, on an upper side of the loading space S, a transport unit 80 (see FIGS. 4 and 5) that transports the uppermost recording medium P among the plural recording media P loaded on the loading portion 16. The recording media P loaded on the loading portion 16 are transported one by one in a transport direction (an arrow A direction) along the apparatus width direction by the transport unit 80, as shown in FIG. 3.

As shown in FIGS. 2 and 3, the sheet feeding device 10 includes a pulling-out tray 26 in which recording media (not shown) having a size smaller than that of the recording media P are stored, in a lower portion on a front side of the main body portion 12 in a depth direction (that is, Z direction). The pulling-out tray 26 is pulled out from the main body portion 12, so that the recording media (not shown) having the size smaller than that of the recording media P have are stored.

The sheet feeding device 10 includes a pulling-out tray 28 that is disposed above the pulling-out tray 26 and on the front side of the main body portion 12 in the depth direction (that is, Z direction). The pulling-out tray 28 is an example of a pulling-out portion. The pulling-out tray 28 can be pulled out toward the front side with respect to a front wall 12A when the mounting device 14 is not mounted on the main body portion 12. When the mounting device 14 is not mounted on the main body portion 12, recording media P2 (see FIG. 5) having a size smaller than that of the recording medium P are loaded inside the pulling-out tray 28.

The sheet feeding device 10 includes a prevention portion 40 that prevents the pulling-out tray 28 from being pulled out in a state where the pulling-out tray 28 is housed in the main body portion 12. Further, the sheet feeding device 10 includes a fixing portion 60 that fixes the pulling-out tray 28 to the main body portion 12 in a state where the pulling-out tray 28 is housed in the main body 12 when the mounting device 14 is mounted on the main body portion 12.

Configuration of Main Body Portion 12

As shown in FIGS. 2 and 3, the main body portion 12 serve as a housing of the sheet feeding device 10. The main body portion 12 includes a front wall 12A disposed on a front side in the apparatus depth direction (that is, Z direction) and a rear wall 12B disposed on a back side in the apparatus depth direction. The main body portion 12 includes a side wall 12C disposed on one side in the apparatus width direction (that is, X direction) and a side wall (not shown in FIG. 2) disposed on the other side in the apparatus width direction. The front wall 12A is configured with plural panels. The pulling-out tray 26 is provided in a range excluding an upper side of the front wall 12A and the other side of the front wall 12A in the apparatus width direction.

The main body portion 12 includes an upper wall 12D disposed on the front wall 12A, the rear wall 12B, the side wall 12C and the other side wall (not shown in FIG. 2). Upper ends of the front wall 12A and the rear wall 12B are connected to the upper wall 12D, and a part of the loading space S is covered with the upper wall 12D.

The front wall 12A and the rear wall 12B sandwich the loading space S on the loading portion 16 from both sides in a direction intersecting with the transport direction of the recording medium P, that is, the apparatus depth direction indicated by the arrow Z. The front wall 12A is provided with a cutout portion 32 in which a height of a portion opposite to the upper wall 12D is lower than a height of a portion of the front wall 12A that is connected to the upper wall 12D (see FIG. 3). When the mounting device 14 is mounted on the main body portion 12, a main body side loading portion 140 that constitutes a part of the loading portion 16 is provided inside the main body portion 12 (see FIG. 4). The main body side loading portion 140 will be described later.

Configuration of Mounting Device 14

The mounting device 14 has a function of accommodating the plural recording media P. As shown in FIGS. 2 and 3, the mounting device 14 protrudes from above the side wall 12C of the main body portion 12 toward the outside of the main body portion 12. The mounting device 14 is disposed across (i) a position between the front wall 12A and the rear wall 12B and (ii) an outside of the side wall 12C. That is, the mounting device 14 is detachably attached to an upper side of the side wall 12C between the front wall 12A and the rear wall 12B of the main body portion 12. The mounting device 14 includes a main body portion 14A and the opening-closing cover 30 provided on an upper side of the main body portion 14A.

In the sheet feeding device 10, the recording media P loaded on the loading portion 16 are transported one by one in the arrow A direction by the transport unit 80 (see FIG. 4) disposed on an upper wall 12D side inside the main body portion 12. The sheet feeding device 10 is provided with side guides 92 that guide a side end portion, in a direction intersecting with the transport direction, of the recording media P loaded on the loading portion 16. The loading portion 16 protrudes from between the front wall 12A and the rear wall 12B to an upstream side in the transport direction (that is, an arrow A direction) of the recording medium P. That is, in the sheet feeding device 10, an upper part of the side wall 12C between the front wall 12A and the rear wall 12B is opened toward the upstream side in the transport direction of the recording medium P, and the loading portion 16 is disposed across the opened portion.

The opening-closing cover 30 is configured to be rotated along the apparatus depth direction by a hinge (not shown) provided on the back side of the main body portion 14A in the apparatus depth direction (that is, Z direction) (see FIG. 3). By rotating the opening-closing cover 30 upward from the front side toward the back side in the apparatus depth direction (Z direction), a part of the loading space S on the loading portion 16 is opened.

Figure 4:
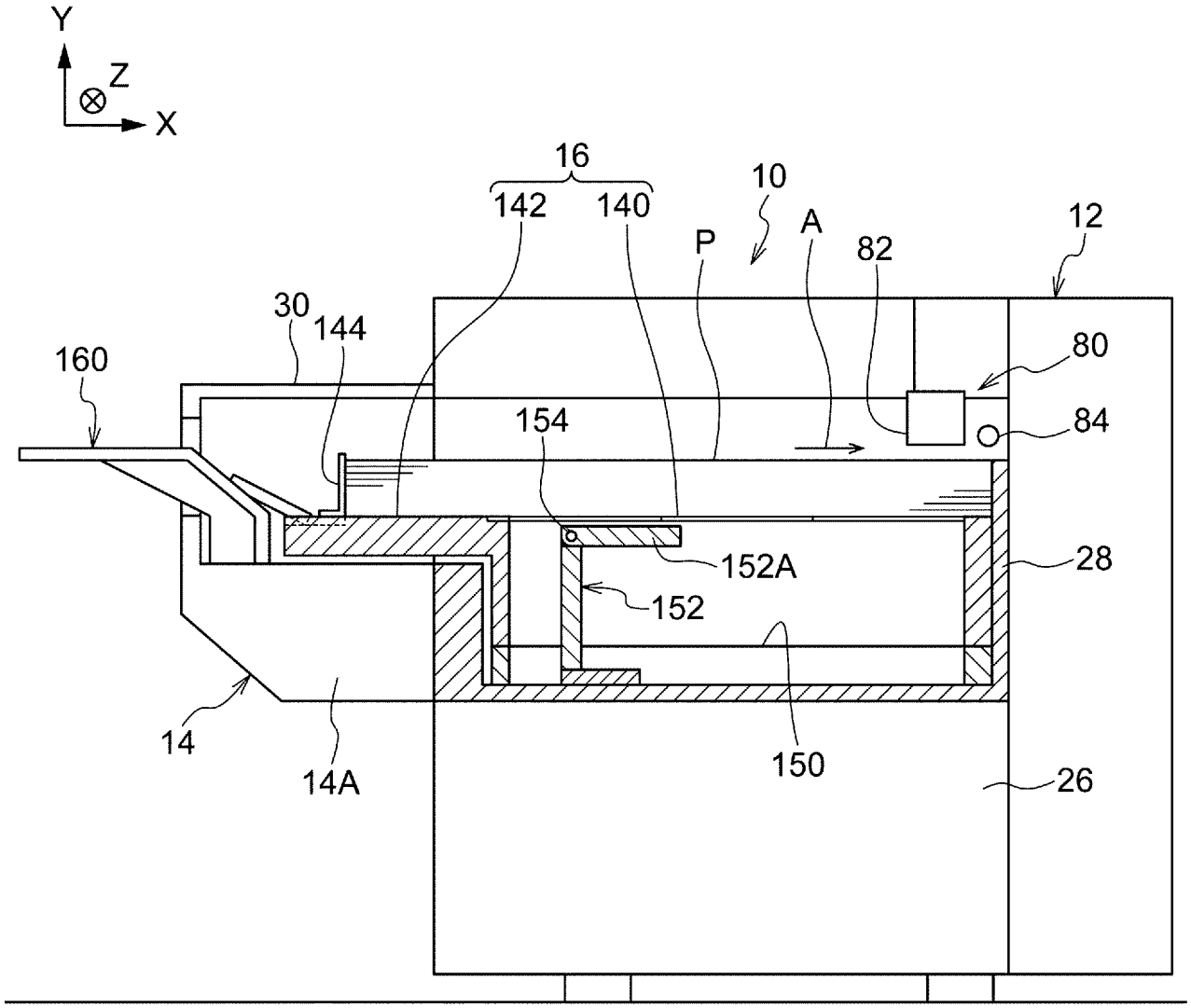
FIG. 4 is a cross-sectional view showing a state where recording media are loaded on the loading portion with a mounting device attached to the sheet feeding device according to the first exemplary embodiment.

As shown in FIG. 4, the loading portion 16 includes the main body side loading portion 140 disposed inside the main body portion 12 and an extension side loading portion 142 extended from the main body side loading portion 140 by mounting the mounting device 14 on the main body portion 12. When the main body side loading portion 140 and the extension side loading portion 142 are coupled to each other in a horizontal direction, the main body side loading portion 140 and the extension side loading portion 142 can be moved up and down in an integrated state.

The extension side loading portion 142 is attached to a side portion of the main body side loading portion 140, and is disposed across an inside of the main body portion 14A of the mounting device 14 from the inside of the main body portion 12. In other words, the extension side loading portion 142 protrudes from between the front wall 12A and the rear wall 12B to the upstream side in the transport direction (that is, arrow A direction) of the recording medium P (see FIG. 3). In the sheet feeding device 10, an upper part of the side wall 12C between the front wall 12A and the rear wall 12B is opened toward the upstream side in the transport direction of the recording medium P (see FIG. 3), and the extension side loading portion 142 is disposed across the opened portion.

An extension unit 160 that extends the loading portion 16 is attached to the mounting device 14 (see FIG. 4). The extension unit 160 is fixed to the main body portion 14A. The extension unit 160 is optionally attached to the mounting device 14. When the extension unit 160 is attached to the mounting device 14, long recording media (not shown) having a length longer than that of the recording media P in a longitudinal direction can be loaded.

Configuration of Opening-Closing Member 20 and Rotating Member 22

The opening-closing member 20 has a function of opening the loading space S on the loading portion 16 in cooperation with the opening-closing cover 30 in a shared manner so as to load the plural recording media P on the loading portion 16. As shown in FIGS. 2 and 3, the opening-closing member 20 is provided between upper portions of the front wall 12A and the rear wall 12B. The opening-closing member 20 is disposed on an upper surface of the main body portion 12 in a state where the loading space S on the loading portion 16 is closed. The opening-closing member 20 is rotated around a hinge (not shown) provided on one end in the transport direction (that is, the arrow A direction shown in FIG. 3) of the recording medium P to open and close the loading space S (see FIG. 3) on the loading portion 16.

The rotating member 22 allows placing of a recording medium for manual feeding (not shown) different from the recording medium P on the rotating member 22. The rotating member 22 is rotated around the hinge (not shown) provided on one end in the transport direction (that is, the arrow A direction shown in FIG. 3) of the recording medium P. The rotating member 22 is configured to shift from a posture overlapping with the opening-closing member 20 to a standing posture in response to an operation of opening the loading space S by the opening-closing member 20.

Configuration of Pulling-out Tray 28

As described above, the pulling-out tray 28 can be pulled out toward the front side (that is, the arrow Z direction) with respect to the main body portion 12 when the mounting device 14 is not mounted on the main body portion 12 (when the main body portion 12 is alone). The pulling-out tray 28 can be pulled out toward the front side (that is, the arrow Z direction) with respect to the main body portion 12 by operating a handle 42 (see FIG. 9) provided on the front side in the apparatus depth direction (the arrow Z direction), which will be described later.

Figure 5:
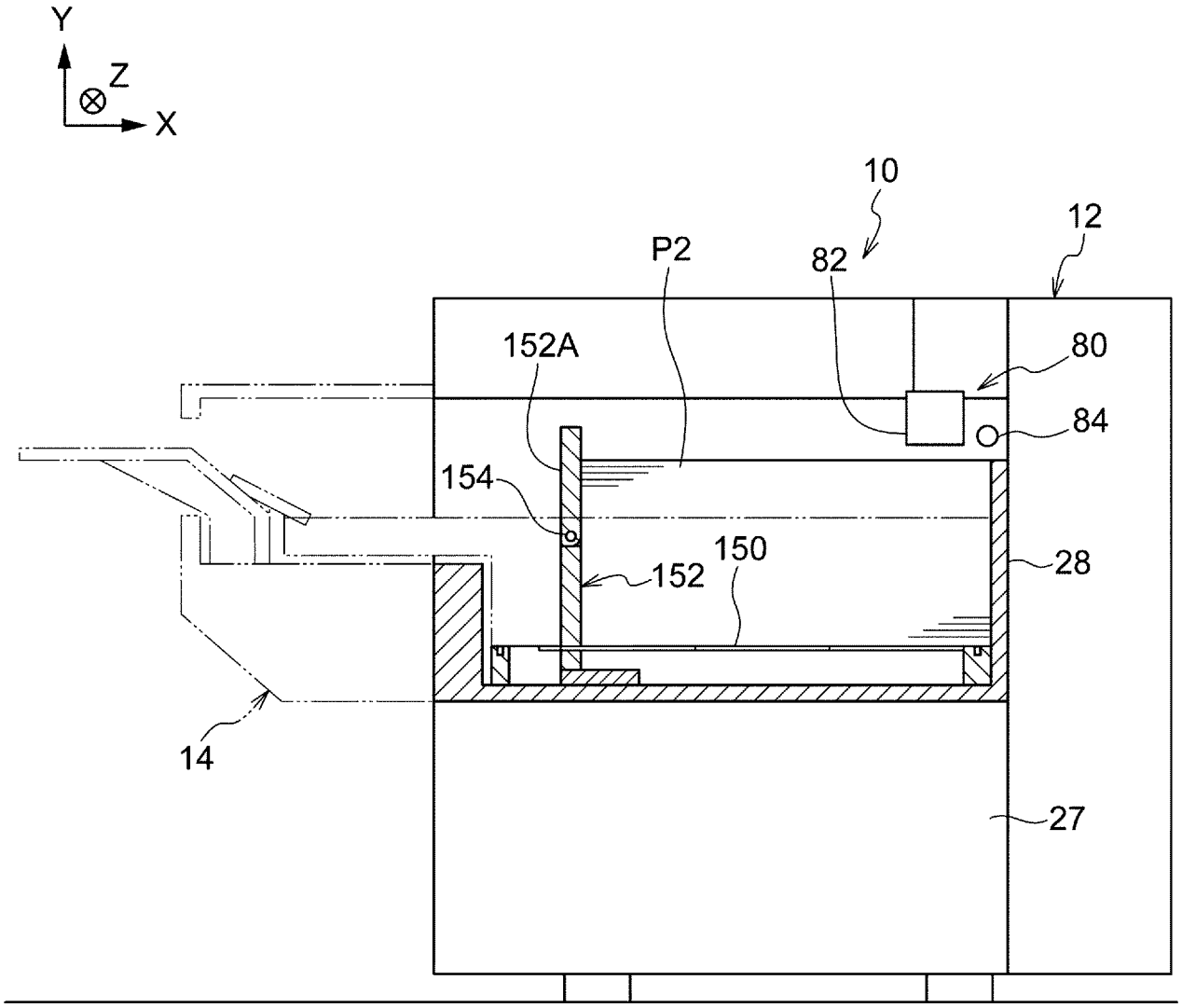
FIG. 5 is a cross-sectional view showing a state where the mounting device is detached from the sheet feeding device according to the first exemplary embodiment.

As shown in FIG. 5, when the mounting device 14 is not mounted on the main body portion 12, a loading portion 150 is provided inside the pulling-out tray 28. Normal-sized recording media P2 having a length shorter than that of the recording media P in the longitudinal direction can be loaded on the loading portion 150. An end guide 152 that regulates an end surface of the recording media P2 in the longitudinal direction is provided at an upstream end portion of the loading portion 150 in the transport direction of the recording media P2. The end guide 152 is provided with a hinge portion 154 in an intermediate portion in an upper and lower direction. An upper piece 152A of the end guide 152 can be bent toward an inside of the pulling-out tray 28 (that is, a transport unit 80 side) (see FIG. 4).

As the normal-sized recording medium P2, for example, a recording medium P2 having a length in the longitudinal direction up to 488 mm may be used. As an example of the recording medium P2 having such a size, a recording medium having an A3 size or less is applicable.

As shown in FIG. 4, when the mounting device 14 is mounted on the main body portion 12, a part of the mounting device 14 is mounted on the pulling-out tray 28 from the upstream side in the transport direction (the arrow A direction) of the recording medium P. The mounting device 14 is disposed above the loading portion 150 of the pulling-out tray 28. In a state where the pulling-out tray 28 is housed in the main body portion 12, the mounting device 14 is detachably attached to an upper side of the loading portion 150 of the pulling-out tray 28. In the present exemplary embodiment, the mounting device 14 is configured to be mounted onto the main body portion 12 so as to be located upstream of the pulling-out tray 28 in the transport direction of the recording medium P.

In a state where the mounting device 14 is mounted on the main body portion 12, the recording media P having a length longer than that of the recording media P2 (see FIG. 5) in the longitudinal direction can be loaded on the loading portion 16. When the mounting device 14 is mounted on the main body portion 12, the hinge portion 154 of the end guide 152 bends the upper piece 152A of the end guide 152 toward the inside of the pulling-out tray 28 (that is, the transport unit 80 side), so that the end guide 152 is folded. In this state, the main body side loading portion 140 is disposed above the end guide 152. The main body side loading portion 140 is, for example, a box-shaped member, and is attached to the loading portion 150 so as to surround the end guide 152.

An end guide 144 that regulates an end surface of the recording media P in the longitudinal direction is provided at an upstream end portion of the loading portion 16 in the transport direction of the recording media P. The end guide 144 is detachably attached to the extension side loading portion 142.

For example, a length of the loading portion 16 in the longitudinal direction is, for example, 490 mm or more and 900 mm or less. With this configuration, the recording media P having a length longer than that of the recording media P2 having an A3 size in the longitudinal direction can be loaded on the loading portion 16. For example, recording media P having a size in which a length in the longitudinal direction is longer than 488 mm and 864 mm or less can be loaded on the loading portion 16 as the long recording media P.

The sheet feeding device 10 is provided with a lifting device (not shown) that moves the loading portion 16 in the upper and lower direction. For example, the lifting device moves up the loading portion 16 such that a position of the uppermost recording medium P among the plural recording media P loaded on the loading portion 16 is at a predetermined height. When the mounting device 14 is not mounted on the main body portion 12, the lifting device moves the loading portion 150 in the upper and lower direction.

Figure 8:
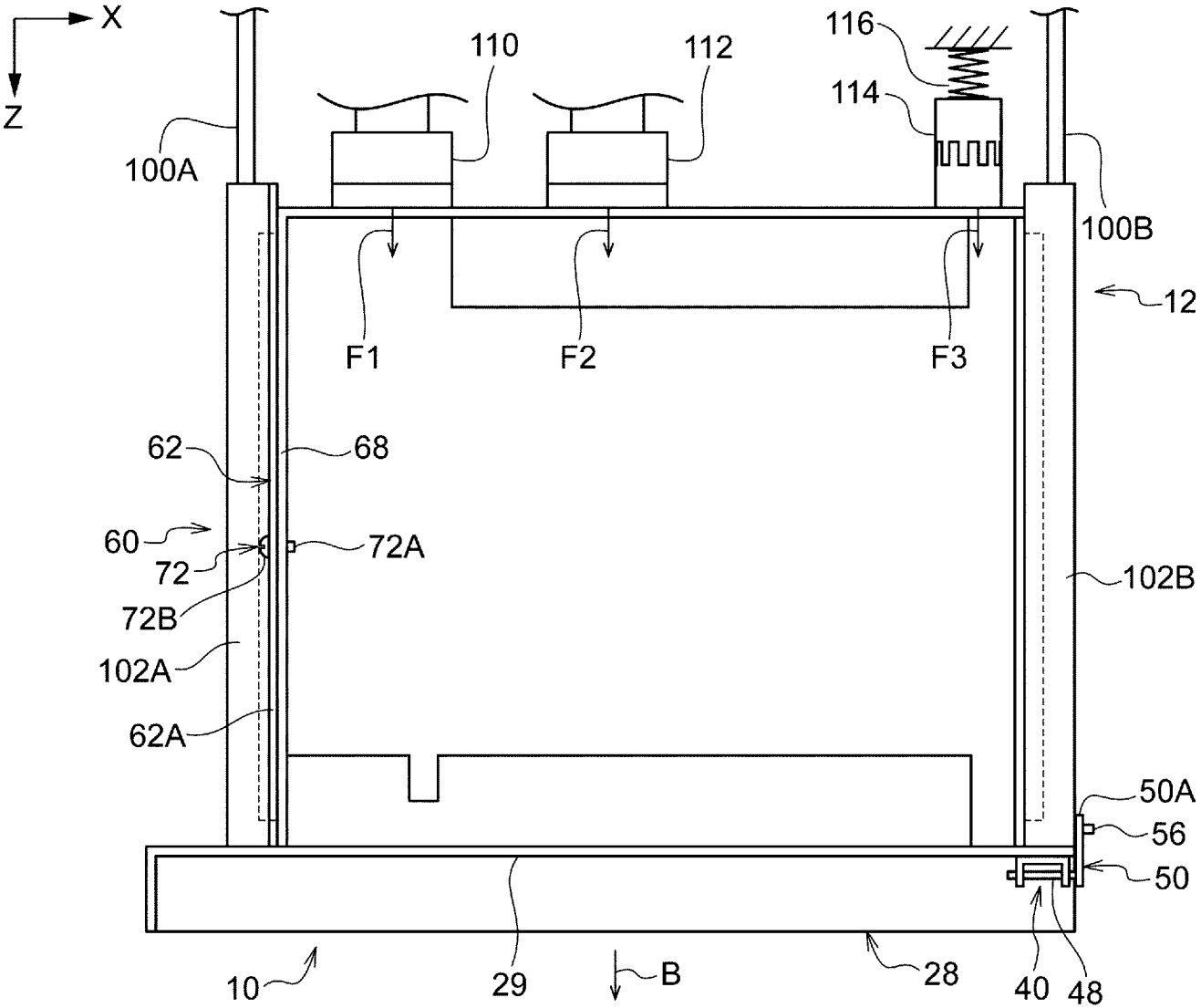
FIG. 8 is a plan view showing the main body portion and the pulling-out portion used in the sheet feeding device according to the first exemplary embodiment.

As shown in FIG. 8, the main body portion 12 of the sheet feeding device 10 is provided with a pair of left and right rail portions 100A and 100B disposed along the apparatus depth direction (the arrow Z direction). The pulling-out tray 28 includes moving portions 102A and 102B that are moved along the rail portions 100A and 100B, on both sides of the pulling-out tray 28 in the width direction (the arrow X direction). The moving portions 102A and 102B are disposed along the apparatus depth direction (the arrow Z direction). The moving portions 102A and 102B have, for example, laterally symmetrical shapes, and are U-shaped members that cover a part of the rail portions 100A and 100B. When the moving portions 102A and 102B of the pulling-out tray 28 move while sliding on the rail portions 100A and 100B of the main body portion 12, the pulling-out tray 28 is pulled out of the main body portion 12 in the arrow B direction.

As an example, a drawer connector 110, an interlock 112, and a coupling mechanism 114 are provided on the back side of the main body portion 12 in the depth direction (the arrow Z direction). The drawer connector 110 is a connector that connects the pulling-out tray 28 and the main body portion 12 at a portion where there are a lot of fitting on the back side of the main body portion 12 in the depth direction. A reaction force F1 of the drawer connector 110 acts on the pulling-out tray 28 in a direction in which the pulling-out tray 28 is pulled out from the main body portion 12.

The interlock 112 is a safety device that prevents the sheet feeding device 10 from operating when predetermined conditions are not met in a state where the pulling-out tray 28 is housed in the main body portion 12. A reaction force F2 of the interlock 112 acts on the pulling-out tray 28 in a direction in which the pulling-out tray 28 is pulled out from the main body portion 12.

The coupling mechanism 114 has a function of coupling a driving gear of the main body portion 12 and a driving gear of the pulling-out tray 28 in the state where the pulling-out tray 28 is housed in the main body portion 12. The coupling mechanism 114 is provided with a coil spring 116 that pushes the driving gear of the main body portion 12 toward the driving gear of the pulling-out tray 28. A pushing force F3 of the coil spring 116 from the coupling mechanism 114 acts on the pulling-out tray 28 in the direction in which the pulling-out tray 28 is pulled out from the main body portion 12.

The reaction force F1 of the drawer connector 110, the reaction force F2 of the interlock 112, and the pushing force F3 of the coil spring 116 act on the pulling-out tray 28 in the direction in which the pulling-out tray 28 is pulled out from the main body portion 12. Therefore, in order to prevent the pulling-out tray 28 from being displaced with respect to the main body portion 12 in a pulling out direction, the sheet feeding device 10 includes the fixing portion 60 together with the prevention portion 40.

Configuration of Prevention Portion 40

Figure 9:
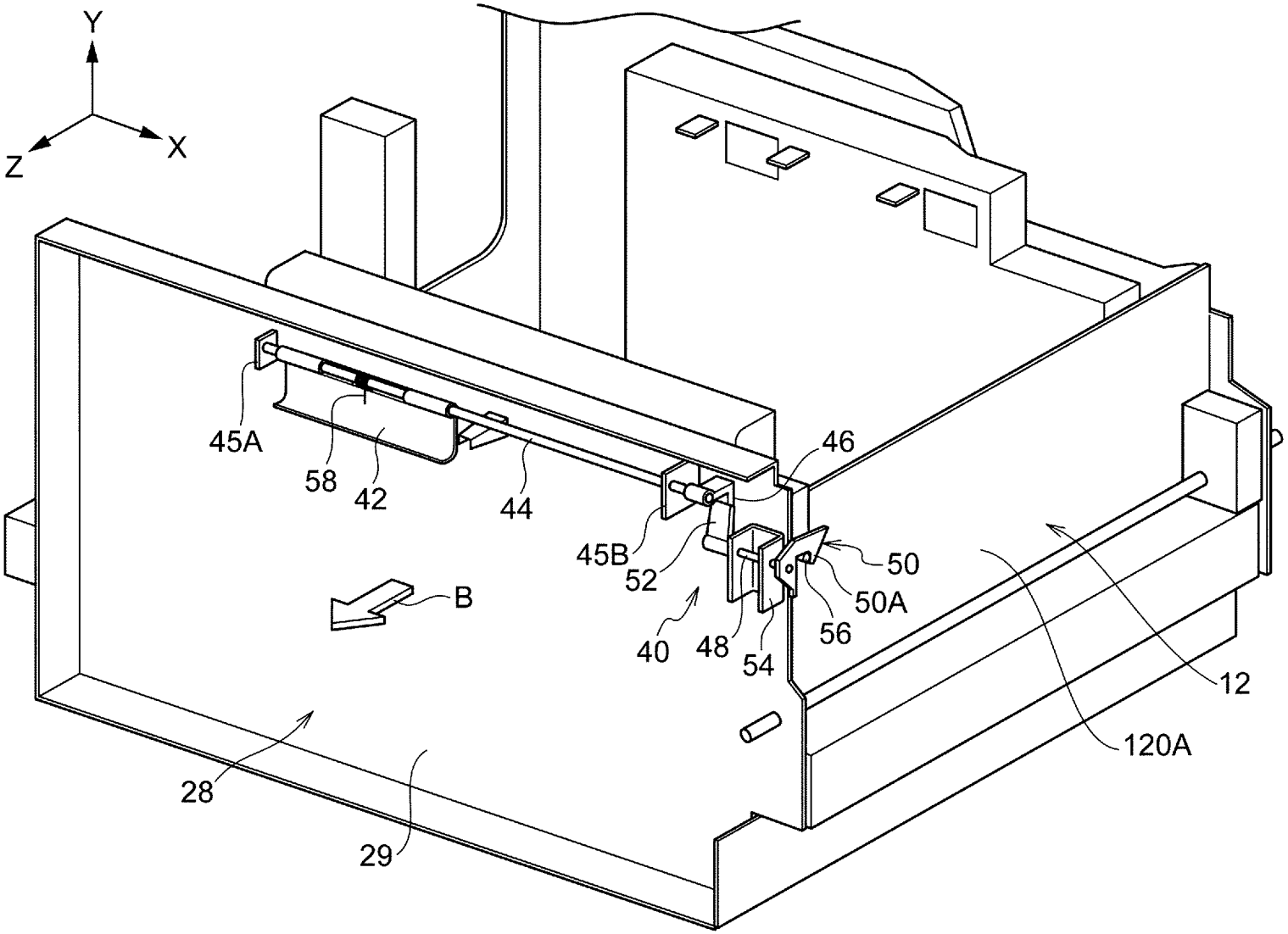
FIG. 9 is a plan view showing a prevention portion that prevents the pulling-out portion used in the sheet feeding device according to the first exemplary embodiment from being pulled out from the main body portion.

The prevention portion 40 has a function of preventing the pulling-out tray 28 from being pulled out in the state where the pulling-out tray 28 is housed in the main body portion 12. As shown in FIG. 9, the prevention portion 40 is provided at a position on a pulling out side of the pulling-out tray 28 with respect to the main body portion 12 (that is, a position on a front side in the pulling out direction indicated by the arrow B). The prevention portion 40 includes the handle 42 provided on the vertical wall portion 29 on a front side of the pulling-out tray 28, and a support rod 44 that supports the handle 42 and is rotatable. The prevention portion 40 includes a pressing portion 46 attached to one end portion side of the support rod 44 in an axial direction. The vertical wall portion 29 is disposed inside a front surface portion 28A (see FIG. 2) of the pulling-out tray 28.

The prevention portion 40 includes a rotating rod 48 rotatably supported on the one end portion side of the support rod 44 in the axial direction, and a latch 50 attached to one end portion side of the rotating rod 48 in the axial direction. Further, the prevention portion 40 includes a protruding portion 52 that is attached to the other end portion side of the rotating rod 48 in the axial direction and comes into contact with the pressing portion 46.

The support rod 44 is disposed along the transport direction (the arrow A direction) of the recording medium P. Both sides of the support rod 44 in the axial direction are rotatably supported by attachment portions 45A and 45B fixed to an upper portion of the vertical wall portion 29.

The handle 42 is attached to an intermediate portion of the support rod 44 in the axial direction. Although not shown, the handle 42 is provided inside a recessed portion 130 provided in the front surface portion 28A (see FIG. 2) of the pulling-out tray 28. The handle 42 is biased by a biasing member 58 such as a torsion coil spring so as to swing toward the back side in the apparatus depth direction (the arrow Z direction). In a state where the mounting device 14 is mounted on the main body portion 12, the recessed portion 130 is closed by a plate-shaped closing portion 132 such that the handle 42 cannot be operated (see FIG. 2). The pressing portion 46 is provided on the support rod 44 in the axial direction on a downstream side in the transport direction of the recording medium P.

The rotating rod 48 is disposed along the transport direction (the arrow A direction) of the recording medium P. The rotating rod 48 is provided on the upper portion of the vertical wall portion 29 on the downstream side in the transport direction of the recording medium P. The rotating rod 48 is rotatably supported by an attachment portion 54 fixed to the upper portion of the vertical wall portion 29. As an example, the attachment portion 54 is a member bent in a U shape, and the rotating rod 48 is rotatably supported at both end portions of the attachment portion 54.

The latch 50 is provided on the rotating rod 48 on the downstream side in the transport direction of the recording medium P. The latch 50 is swingably supported by the rotating rod 48. One end portion of the latch 50 is attached to the rotating rod 48. The latch 50 includes a pawl portion 50A at the other end portion on a side opposite to the rotating rod 48. The main body portion 12 includes a vertical wall portion 120A disposed along the apparatus depth direction (the arrow Z direction). The vertical wall portion 120A is provided with a rod 56 to which the pawl portion 50A of the latch 50 is locked (see FIG. 10). The rotating rod 48 is provided with a biasing member (not shown) such as a torsion coil spring that biases the pawl portion 50A of the latch 50 in a direction of being locked to the rod 56. The protruding portion 52 comes into contact with the pressing portion 46 in a state where the pawl portion 50A of the latch 50 is locked to the rod 56. By locking the pawl portion 50A of the latch 50 to the rod 56, the pulling-out tray 28 is prevented from being pulled out from the main body portion 12.

In the prevention portion 40, the protruding portion 52 comes into contact with the pressing portion 46 in a state where the handle 42 is swung toward the back side in the apparatus depth direction (the arrow Z direction) by the biasing member 58. In this state, the pawl portion 50A of the latch 50 is locked to the rod 56 of the main body portion 12. In the prevention portion 40, the pawl portion 50A of the latch 50 is locked to the rod 56 of the main body portion 12 on the downstream side of the pulling-out tray 28 in the transport direction of the recording medium P. The prevention portion 40 locks the upper portion of the pulling-out tray 28 in the upper and lower direction to the rod 56 of the main body portion 12 by the pawl portion 50A of the latch 50.

Figure 10:
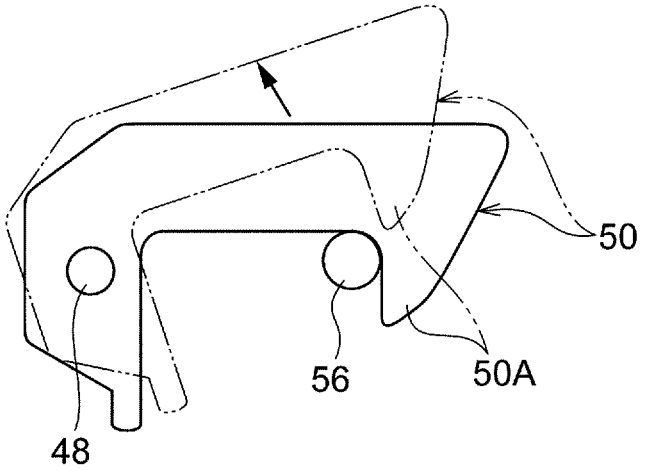
FIG. 10 is a plan view showing a state where a latch of the prevention portion used in the sheet feeding device according to the first exemplary embodiment is locked to a rod.

When the pulling-out tray 28 is pulled out from the main body portion 12, the handle 42 is swung toward the front side in the apparatus depth direction (the arrow Z direction) against a biasing force of the biasing member 58, so that the locking of the main body portion 12 to the rod 56 is released by the prevention portion 40. That is, when the handle 42 is swung toward the front side in the apparatus depth direction (the arrow Z direction), the pressing portion 46 is rotated toward the front side in the depth direction (the arrow Z direction) due to a rotation of the support rod 44. Accordingly, when the pressing portion 46 pushes the protruding portion 52 toward the front side in the depth direction (the arrow Z direction), the rotating rod 48 is rotated, and the pawl portion 50A of the latch 50 is rotated in a direction in which the pawl portion 50A of the latch 50 is unlocked from the rod 56 (FIG. 10). Therefore, the pawl portion 50A of the latch 50 is unlocked from the rod 56, and the pulling-out tray 28 can be pulled out from the main body portion 12 in the arrow B direction.

Configuration of Fixing Portion 60

Figure 6:
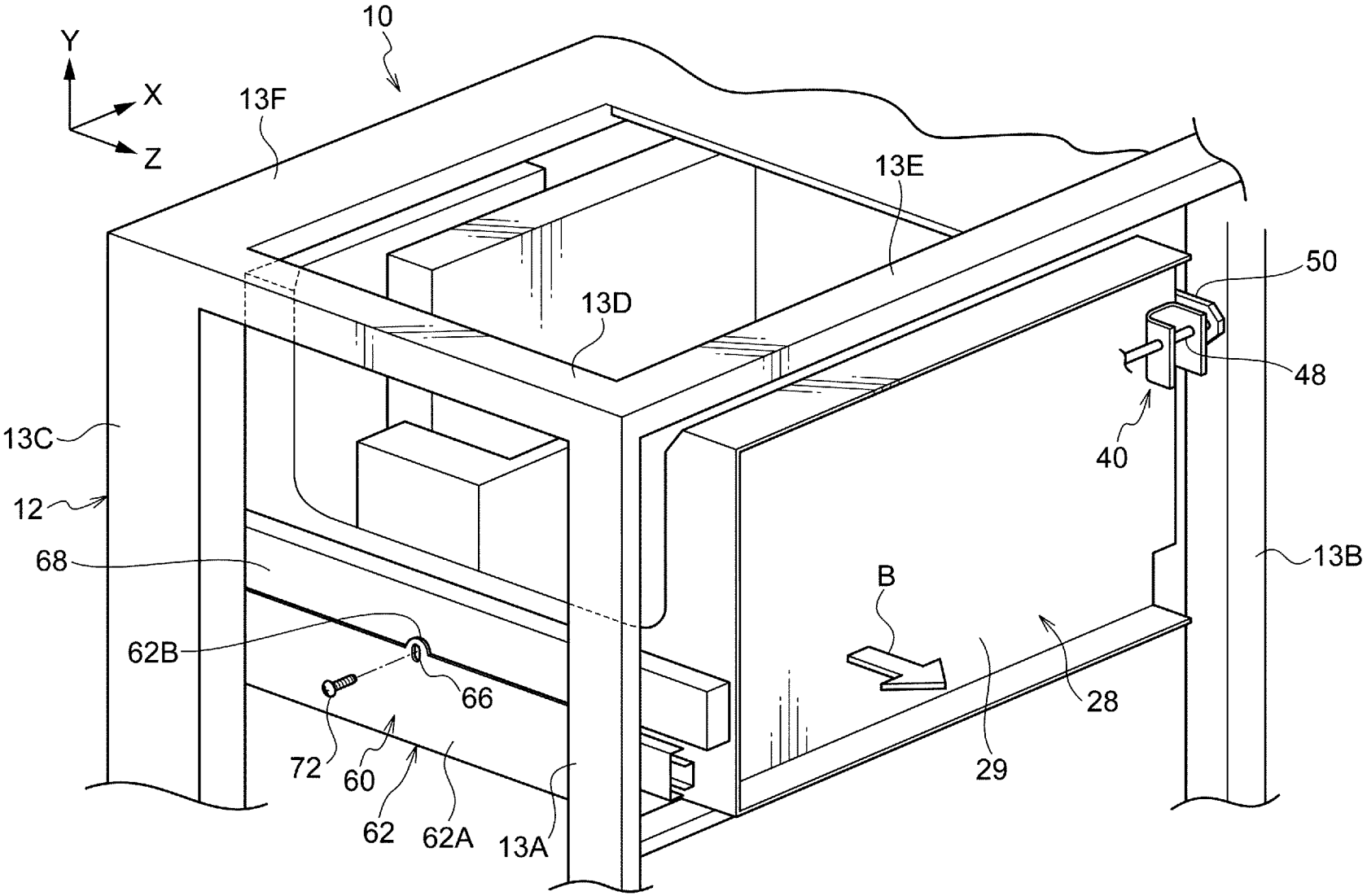
FIG. 6 is a perspective view showing a main body portion and a pulling-out portion used in the sheet feeding device according to the first exemplary embodiment.

As shown in FIG. 6, the main body portion 12 includes plural vertical frames 13A, 13B, 13C (only a part of the vertical frames are shown in FIG. 6) disposed along the upper and lower direction near a corner of the main body portion 12. For example, the vertical frames 13A and 13B are disposed on the front side in the apparatus depth direction (the arrow Z direction), and the vertical frame 13C is disposed on the back side in the apparatus depth direction (the arrow Z direction). The main body portion 12 includes lateral frames 13D, 13E, and 13F (only a part of the lateral frames are shown in FIG. 6) disposed along a lateral direction near the corner of the main body portion 12. Each of the lateral frames 13D, 13E, and 13F is bridged on two adjacent vertical frames among the vertical frames 13A, 13B, and 13C.

Figure 7:
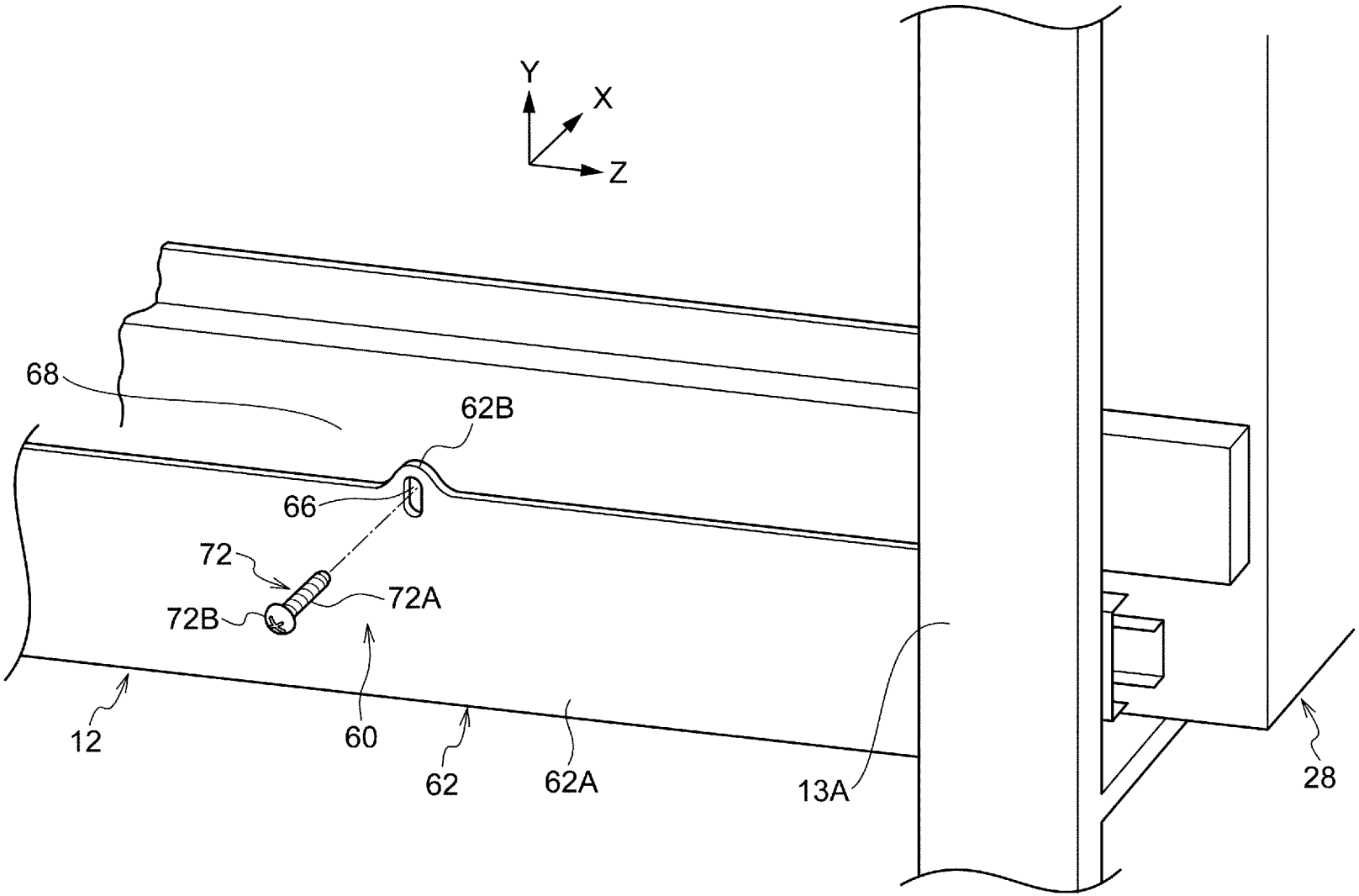
FIG. 7 is a perspective view showing a fixing portion that fixes the pulling-out portion used in the sheet feeding device according to the first exemplary embodiment to the main body portion.

As shown in FIGS. 6 to 8, the fixing portion 60 includes a hole 66 provided in a lateral frame 62 bridged on intermediate portions of the vertical frames 13A and 13C in the upper and lower direction, and a fastener 72 that is inserted through the hole 66 and fixes the pulling-out tray 28 to the lateral frame 62. The lateral frame 62 is provided on the main body portion 12. The lateral frame 62 is an example of a frame.

More specifically, the lateral frame 62 is disposed, for example, along the apparatus depth direction (the arrow Z direction) of the main body portion 12. The lateral frame 62 is disposed at an upstream portion of the main body portion 12 in the transport direction (the arrow A direction) of the recording medium P. The lateral frame 62 includes a slim plate-shaped frame main body 62A and a protruding portion 62B protruding upward from an intermediate portion of the frame main body 62A in a longitudinal direction thereof. The frame main body 62A is disposed such that a plate-shaped surface extends along the upper and lower direction. The protruding portion 62B has, for example, a semicircular curved shape. The hole 66 is formed across the protruding portion 62B and the frame main body 62A. The hole 66 is an elongated hole that is long in the upper and lower direction.

The pulling-out tray 28 includes a side frame 68 that is disposed so as to face the lateral frame 62 when the pulling-out tray 28 is housed in the main body portion 12. The side frame 68 is disposed, for example, on a lower portion of the pulling-out tray 28 along the apparatus depth direction (the arrow Z direction).

The fastener 72 is, for example, a screw, and includes a shaft portion 72A and a head portion 72B. An inner diameter of the hole 66 is dimensioned such that the shaft portion 72A can be inserted through the hole 66 and the head portion 72B can come into contact with the lateral frame 62 around the hole 66.

The fixing portion 60 fixes the side frame 68 to the lateral frame 62 of the main body portion 12 by inserting the shaft portion 72A of the fastener 72 into the hole 66 and fastening the shaft portion 72A to the side frame 68. Although not shown, the side frame 68 may include a screw hole to which the shaft portion 72A of the fastener 72 is fastened. The fixing portion 60 detachably fastens and fixes the pulling-out tray 28 to the main body portion 12. In the present exemplary embodiment, the fastener 72 penetrates the lateral frame 62 and is detachably fastened to the side frame 68. By loosening the fastening of the fastener 72, the fastener 72 can be detached from the side frame 68 and the lateral frame 62. When the mounting device 14 is not mounted on the main body portion 12, the handle 42 of the prevention portion 40 is swung toward the front side in the apparatus depth direction (the arrow Z direction), which is a release direction, in a state where the fastener 72 is detached, so that the pulling-out tray 28 can be pulled out from the main body portion 12.

The fixing portion 60 fixes the side frame 68 on the upstream side of the pulling-out tray 28 in the transport direction of the recording medium P to the lateral frame 62 of the main body portion 12. The fixing portion 60 is provided at an intermediate portion of the pulling-out tray 28 in the pulling out direction (the arrow B direction).

The fixing portion 60 fixes the side frame 68 on the lower portion of the pulling-out tray 28 in the upper and lower direction to the lateral frame 62 of the main body portion 12. The fixing portion 60 is provided at one position.

Configuration of Transport Unit 80

As shown in FIG. 4, the transport unit 80 includes a suction portion 82 that suctions the uppermost recording medium P loaded on the loading portion 16 from above, and a transport roller 84 that transports the uppermost recording medium P loaded on the loading portion 16. The transport roller 84 is disposed downstream of the suction portion 82 in the transport direction of the recording medium P.

The suction portion 82 includes plural suction ports (not shown) provided at a lower portion of a housing thereof. The suction portion 82 suctions air from the suction ports by a suction device (not shown) to suction the uppermost recording medium P loaded on the loading portion 16. As an example, the suction portion 82 is supported to be movable along the transport direction of the recording medium P, and moves the recording medium P to the downstream side in the transport direction of the recording medium P in a state where the suction portion 82 suctions the recording medium P, so that the suction portion 82 supplies the recording medium P to the transport roller 84.

The transport roller 84 has a function of feeding the uppermost recording medium P loaded on the loading portion 16 by being rotated counterclockwise in FIG. 4. The transport roller 84 transports the recording medium P toward the image forming apparatus 200 (see FIG. 1), that is, in the arrow A direction.

Operations and Effects

Next, operations and effects of the present exemplary embodiment will be described.

The sheet feeding device 10 is provided with the pulling-out tray 28 on which the recording media P are loaded and which can be pulled out from the main body portion 12. In the state where the pulling-out tray 28 is housed in the main body portion 12, the pawl portion 50A of the latch 50 provided on the prevention portion 40 of the pulling-out tray 28 is engaged with the rod 56 of the main body portion 12, so that the pulling-out tray 28 is prevented from being pulled out from the main body portion 12.

In the sheet feeding device 10, the pulling-out tray 28 is fixed to the main body portion 12 by the fixing portion 60 in the state where the pulling-out tray 28 is housed in the main body portion 12. More specifically, the fixing portion 60 includes the fastener 72, the fastener 72 is inserted into the hole 66 of the lateral frame 62 provided in the main body portion 12, and the fastener 72 is fastened to the side frame 68 of the pulling-out tray 28, so that the pulling-out tray 28 is fixed to the main body portion 12.

As shown in FIG. 8, the reaction force F1 of the drawer connector 110, the reaction force F2 of the interlock 112, and the pushing force F3 of the coil spring 116 act on the pulling-out tray 28 in the direction in which the pulling-out tray 28 is pulled out from the main body portion 12.

Here, as a comparative example, a sheet feeding device provided with simply a prevention portion including a latch will be described. In the sheet feeding device according to the comparative example, a latch of the prevention portion is locked to a rod of a main body portion, so that a pulling-out tray is prevented from being pulled out from the main body portion. For example, the prevention portion is disposed on a downstream side in a transport direction of the recording medium P.

In the sheet feeding device according to the comparative example, due to the reaction force F1 of the drawer connector 110, the reaction force F2 of the interlock 112, and the pushing force F3 of the coil spring 116, an upstream portion of the pulling-out tray in the transport direction of the recording medium P may shift in a pulling out direction with respect to the main body portion. For example, when the pulling-out tray is placed obliquely with respect to the transport direction of the recording medium P, the recording medium P at the time of feeding may be obliquely or laterally displaced.

On the other hand, in the sheet feeding device 10, in order to prevent the pulling-out tray 28 from being pulled out from the main body portion 12, the fixing portion 60 is provided together with the prevention portion 40. In the sheet feeding device 10, the pulling-out tray 28 is fixed to the main body portion 12 by the fixing portion 60 in a state where the pulling-out tray 28 is housed in the main body portion 12. Therefore, in the sheet feeding device 10, when the mounting device 14 is mounted on the main body portion 12, the recording media P loaded on the mounting device 14 are prevented from being obliquely or laterally displaced with respect to the main body portion 12, as compared with a case where the pulling-out portion is restrained to the main body portion simply by the prevention portion.

In the sheet feeding device 10, the fixing portion 60 detachably fastens and fixes the pulling-out tray 28 to the main body portion 12. That is, the fastener 72 of the fixing portion 60 fastens and fixes the pulling-out tray 28 to the main body portion 12 and can be detached from the pulling-out tray 28 and the main body portion 12. Therefore, in the sheet feeding device 10, the pulling-out portion is less likely to be displaced with respect to the main body portion as compared with a case where the pulling-out portion is fixed to the main body portion with a clip. Since the fastener 72 of the fixing portion 60 are detachable from the pulling-out tray 28 and the main body portion 12, a fixing portion is easier to handle as compared with a configuration in which the fixing portion cannot be detached from the pulling-out tray and the main body portion.

In the sheet feeding device 10, in a state where the pulling-out tray 28 is housed in the main body portion 12, the mounting device 14 is detachably provided on an upper side of the loading portion 150 of the pulling-out tray 28. In the mounting device 14, the recording media P longer than the recording media P2 (see FIG. 5) loaded on the loading portion 150 of the pulling-out tray 28 are loaded across the mounting device 14 and the pulling-out tray 28 (see FIG. 4). Therefore, in the sheet feeding device 10, the recording media P loaded on the mounting device 14 are prevented from being obliquely or laterally displaced with respect to the main body portion 12, as compared with a case where the pulling-out portion is restrained to the main body portion simply by the prevention portion.

The sheet feeding device 10 is provided with the transport unit 80 that transports the recording media P loaded on the mounting device 14. The mounting device 14 is configured to be mounted on the main body portion 12 so as to be located upstream of the pulling-out tray 28 in the transport direction of the recording medium P. Therefore, in the sheet feeding device 10, a structure in which the mounting device 14 is mounted on the main body portion 12 is simple, as compared with a case where the mounting member is mounted on the main body portion so as to be located downstream of the pulling-out portion in the transport direction of the recording medium.

In the sheet feeding device 10, the fixing portion 60 fixes the side frame 68 on the upstream side of the pulling-out tray 28 in the transport direction of the recording medium P to the main body portion 12. Therefore, in the sheet feeding device 10, the fixing portion 60 is easier to operate as compared with a case where a downstream portion of the pulling-out portion in the transport direction of the recording medium is fixed to the main body portion.

In the sheet feeding device 10, the prevention portion 40 includes the latch 50, and the pawl portion 50A of the latch 50 is locked to the rod 56 of the main body portion 12 on the downstream side of the pulling-out tray 28 in the transport direction of the recording medium P. Therefore, in the sheet feeding device 10, the pulling-out tray 28 is less likely to be displaced with respect to the main body 12 as compared with a case where the prevention portion is locked to the main body portion on the upstream side of the pulling-out portion in the transport direction of the recording medium.

In the sheet feeding device 10, the latch 50 of the prevention portion 40 is provided on a pulling out side of the pulling-out tray 28 in the pulling out direction (an arrow B direction). The fixing portion 60 is provided at the intermediate portion of the pulling-out tray 28 in the pulling out direction (the arrow B direction). Therefore, in the sheet feeding device 10, the pulling-out tray 28 is less likely to be displaced with respect to the main body portion 12 as compared with a case where the prevention portion and the fixing portion are provided on the pulling out side of the pulling-out portion.

In the sheet feeding device 10, the fixing portion 60 fixes the side frame 68, which is a lower portion of the pulling-out tray 28 in the upper and lower direction, to the main body portion 12. Therefore, in the sheet feeding device 10, a position closer to the recording media P loaded on the mounting device 14 is fixed as compared with a case where the fixing portion fixes the upper portion of the pulling-out portion in the upper and lower direction to the main body portion.

In the sheet feeding device 10, the fixing portion 60 fixes the side frame 68 on the lower portion of the pulling-out tray 28 in the upper and lower direction to the main body portion 12, and the prevention portion 40 locks the latch 50 on the upper portion of the pulling-out tray 28 in the upper and lower direction to the rod 56 of the main body portion 12. Therefore, in the sheet feeding device 10, the pulling-out tray 28 is less likely to be displaced with respect to the main body portion 12 as compared with a case where the prevention portion and the fixing portion are located at the lower portion of the pulling-out portion in the upper and lower direction.

In the sheet feeding device 10, the fixing portion 60 is provided at one position. Therefore, in the sheet feeding device 10, the pulling-out tray 28 is less likely to be displaced with respect to the main body portion 12 even though the fixing portion is provided at one position.

In the sheet feeding device 10, the fixing portion 60 fixes the pulling-out tray 28 to the lateral frame 62 provided on the main body portion 12. Therefore, in the sheet feeding device 10, the pulling-out tray 28 is more stably fixed to the main body portion 12 by the fixing portion 60 as compared with a case where the fixing portion fixes the pulling-out portion to a portion extending from the main body portion.

In the sheet feeding device 10, the recording media P loaded on the mounting device 14 are longer than the recording medium having an A3 size in the longitudinal direction. Therefore, in the sheet feeding device 10, the recording media P longer than the recording medium having the A3 size can be loaded.

The image forming apparatus 200 includes the sheet feeding device 10, and the recording media P are transported from the sheet feeding device 10 to the image forming apparatus main body 202. Therefore, in the image forming apparatus 200, when the mounting device 14 is mounted on the main body portion 12, the recording media P loaded on the mounting device 14 are prevented from being transported with an oblique or lateral displacement, as compared with a case where the pulling-out portion is restrained to the main body portion simply by the prevention portion.

Supplementary Description

The sheet feeding device 10 according to the first exemplary embodiment is provided with the transport unit 80. It is noted that the present disclosure is not limited thereto. For example, the technique of the present disclosure is also applicable to an accommodating device not provided with the transport unit 80.

In the sheet feeding device 10 according to the first exemplary embodiment, configurations of the main body portion 12 and the pulling-out tray 28 may be changed within the scope of the present disclosure.

In the sheet feeding device 10 according to the first exemplary embodiment, the fixing portion 60 includes the fastener 72. It is noted that the present disclosure is not limited to this configuration. For example, the fixing portion may fix a pulling-out portion such as a pulling-out tray to a main body portion by a clip or the like. The fixing portion does not have to be detachable from the pulling-out portion and the main body portion. For example, the fixing portion may fix the pulling-out portion to the main body portion by crimping or the like.

In the sheet feeding device 10 according to the first exemplary embodiment, the fixing portion 60 fixes the upstream portion of the pulling-out tray 28 in the transport direction of the recording medium P to the main body portion 12. The position of the fixing portion in the transport direction of the recording medium P may be changed.

In the sheet feeding device 10 according to the first exemplary embodiment, the prevention portion 40 is locked to the main body portion 12 on the downstream side of the pulling-out tray 28 in the transport direction of the recording medium P. The position of the prevention portion in the transport direction of the recording medium P may be changed.

In the sheet feeding device 10 according to the first exemplary embodiment, the prevention portion 40 is provided on the pulling out side of the pulling-out tray 28, and the fixing portion 60 is provided in the intermediate portion of the pulling-out tray 28. The positions of the prevention portion and the fixing portion in the pulling out direction may be changed. For example, the prevention portion may be provided on the pulling out side of the pulling-out portion, and the fixing portion may be provided on the side opposite to the pulling out side of the pulling-out portion.

In the sheet feeding device 10 according to the first exemplary embodiment, the fixing portion 60 fixes the lower portion of the pulling-out tray 28 in the upper and lower direction to the main body portion 12. The position of the fixing portion in the upper and lower direction may be changed.

In the sheet feeding device 10 according to the first exemplary embodiment, the prevention portion 40 fixes the upper portion of the pulling-out tray 28 in the upper and lower direction to the main body portion 12. The position of the prevention portion in the upper and lower direction may be changed.

In the sheet feeding device 10 according to the first exemplary embodiment, the fixing portion 60 is provided at one position. The fixing portions may be provided at two or more positions.

In the sheet feeding device 10 according to the first exemplary embodiment, the fixing portion 60 fixes the pulling-out tray 28 to the lateral frame 62 provided in the main body portion 12. The fixing portion 60 may fix the pulling-out portion to another portion of the main body portion.

In the sheet feeding device 10 according to the first exemplary embodiment, the recording media P such as sheets of paper are used. The present disclosure is not limited thereto. The supply device according to the present disclosure is applicable to any sheet-shaped medium (for example, a metal sheet, a resin sheet, and a cloth sheet) other than the recording medium such as a sheet of paper.

While the present disclosure has been described in detail with reference to specific exemplary embodiments, it will be apparent to those skilled in the art that various other exemplary embodiments are possible within the scope of the present disclosure.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An accommodating device comprising:

a main body portion;

a pulling-out portion on which recording media are loaded, the pulling-out portion being capable of being pulled out from the main body portion;

a prevention portion configured to prevent the pulling-out portion from being pulled out by being locked to the main body portion in a state where the pulling-out portion is housed in the main body portion; and a fixing portion configured to fix the pulling-out portion to the main body portion in the state where the pulling-out portion is housed in the main body portion.

2. The accommodating device according to claim 1, wherein the fixing portion detachably fastens and fixes the pulling-out portion to the main body portion.

3. The accommodating device according to claim 2, further comprising:

a mounting member that is detachably provided on an upper side of the pulling-out portion in the state where the pulling-out portion is housed in the main body portion, wherein recording media longer than the recording media loaded on the pulling-out portion are loaded across the mounting member and the pulling-out portion.

4. The accommodating device according to claim 3, further comprising:

a transport unit configured to transport the recording media loaded on the mounting member, wherein the mounting member is configured to be mounted on the main body portion so as to be located upstream of the pulling-out portion in a transport direction of the recording media.

5. The accommodating device according to claim 4, wherein the fixing portion fixes an upstream portion of the pulling-out portion in the transport direction of the recording media to the main body portion.

6. The accommodating device according to claim 5, wherein the prevention portion is locked to the main body portion on a downstream side of the pulling-out portion in the transport direction of the recording media.

7. The accommodating device according to claim 2, wherein the prevention portion is provided on a pulling out side of the pulling-out portion, and the fixing portion is provided (i) on a side opposite to the pulling out side of the pulling-out portion or (ii) on an intermediate portion of the pulling-out portion in a pulling out direction.

8. The accommodating device according to claim 3, wherein the prevention portion is provided on a pulling out side of the pulling-out portion, and the fixing portion is provided (i) on a side opposite to the pulling out side of the pulling-out portion or (ii) on an intermediate portion of the pulling-out portion in a pulling out direction.

9. The accommodating device according to claim 1, further comprising:

a mounting member that is detachably provided on an upper side of the pulling-out portion in the state where the pulling-out portion is housed in the main body portion, wherein recording media longer than the recording media loaded on the pulling-out portion are loaded across the mounting member and the pulling-out portion.

10. The accommodating device according to claim 9, further comprising:

a transport unit configured to transport the recording media loaded on the mounting member, wherein the mounting member is configured to be mounted on the main body portion so as to be located upstream of the pulling-out portion in a transport direction of the recording media.

11. The accommodating device according to claim 10, wherein the fixing portion fixes an upstream portion of the pulling-out portion in the transport direction of the recording media to the main body portion.

12. The accommodating device according to claim 11, wherein the prevention portion is locked to the main body portion on a downstream side of the pulling-out portion in the transport direction of the recording media.

13. The accommodating device according to claim 9, wherein the prevention portion is provided on a pulling out side of the pulling-out portion, and the fixing portion is provided (i) on a side opposite to the pulling out side of the pulling-out portion or (ii) on an intermediate portion of the pulling-out portion in a pulling out direction.

14. The accommodating device according to claim 9, wherein the recording media loaded on the mounting member are longer than a recording medium having an A3 size in a longitudinal direction.

15. The accommodating device according to claim 1, wherein the prevention portion is provided on a pulling out side of the pulling-out portion, and the fixing portion is provided (i) on a side opposite to the pulling out side of the pulling-out portion or (ii) on an intermediate portion of the pulling-out portion in a pulling out direction.

16. The accommodating device according to claim 15, wherein the fixing portion is provided at one position.

17. The accommodating device according to claim 1, wherein the fixing portion fixes a lower portion of the pulling-out portion in an upper and lower direction to the main body portion.

18. The accommodating device according to claim 17, wherein the prevention portion locks an upper portion of the pulling-out portion in the upper and lower direction to the main body portion.

19. The accommodating device according to claim 1, wherein the fixing portion fixes the pulling-out portion to a frame provided on the main body portion.

20. An image forming apparatus comprising:

the accommodating device according to claim 1, wherein the recording media are transported from the accommodating device to an image forming unit.

* * * * *